US005245732A

United States Patent [19]

Johnston

[11] Patent Number: 5,245,732

[45] Date of Patent: Sep. 21, 1993

[54] JEWELRY CLASP

[76] Inventor: Gessica T. Johnston, 44750 Adobe Dr., Hemet, Calif. 92544

[21] Appl. No.: 953,527

[22] Filed: Sep. 29, 1992

[51] Int. Cl.[5] ..... A44B 18/00

[52] U.S. Cl. ..... 24/306; 224/901

[58] Field of Search ..... 224/202, 163, 222, 219, 224/901; 24/306, 442, 3 R, 3 F; 2/DIG. 6; 403/389

[56] References Cited

U.S. PATENT DOCUMENTS

| | | | |
|---|---|---|---|
| 1,455,993 | 5/1923 | Conway | 403/389 |
| 1,578,468 | 3/1926 | Rankin | 224/163 X |
| 3,260,294 | 7/1966 | Campion | 24/442 X |
| 3,370,818 | 2/1968 | Perr . | |
| 3,414,093 | 12/1968 | Chostner | 24/442 X |
| 3,747,171 | 7/1973 | Montague, Jr. . | |
| 4,065,834 | 1/1978 | Montague, Jr. . | |
| 4,271,566 | 6/1981 | Penna | 24/306 X |
| 4,406,296 | 9/1983 | Wexler et al. . | |
| 4,596,540 | 6/1986 | F'Geppert . | |
| 4,887,338 | 12/1989 | Handler | 24/306 |
| 5,002,381 | 3/1991 | Murrell . | |
| 5,008,987 | 4/1991 | Armour, II . | |
| 5,025,247 | 6/1991 | Banks . | |
| 5,060,348 | 10/1991 | Moshier . | |
| 5,101,539 | 4/1992 | Kennedy et al. | 24/442 |

*Primary Examiner*—James R. Brittain

*Attorney, Agent, or Firm*—Douglas E. White

[57] ABSTRACT

A jewelry clasp is comprised in part of hook and loop fastener material, such as that available under the brand name VELCRO. A piece of fastener material is glued or otherwise attached to a plastic or metal backing which acts as a first gripping member. The curved (preferably spoon-shaped) first gripping member has a circular eye-screw link protruding out from one side, which link may be tied onto or otherwise linked to one end of a standard necklace string or chain, so as to be more or less permanently secured thereto. A piece of fastener material of opposite type is attached to a generally congruently-shaped second backing or gripping member, which material and gripping member, when linked with an eye-screw to the other end of the necklace, form the second half of the clasp. The two gripping members mate together with relatively loose tolerances. Insofar as the hook and loop fastener material will hold even when the two pieces thereof are not matched exactly together, the clasp readily may be fastened behind the neck by persons with impaired fine motor skills.

14 Claims, 3 Drawing Sheets

JEWELRY CLASP

FIELD OF THE INVENTION

This invention relates to fasteners, more particularly to a jewelry clasp which uses hook and loop fastener material to fasten together two ends of a necklace or the like in a manner in which it easily may be unfastened by individuals experiencing impaired manual dexterity.

BACKGROUND OF THE INVENTION

The elderly may experience arthritis and similar conditions which involve the loss of fine motor skills in the wrists, hands and fingers. Therefore, elderly women often have difficulty fastening necklaces. It is normal to fasten such jewelry with the clasp behind the neck, thereby exacerbating the problem.

Even if the clasp is brought around to the front of the neck, the motor loss and discomfort may be so severe as to prevent ready fastening. Furthermore, it also is common for the elderly to have eye conditions which impair visual acuity, particularly at close distances. There is a need, therefore, for a clasp specifically designed to meet the needs of people who experience difficulty using ordinary clasps.

Prior developments in this field may be generally illustrated by reference to the following information disclosure statement:

| Patent No. | Patentee | Issue Date |
|---|---|---|
| 4,406,296 | H. Wexler et al. | Sep. 27, 1983 |
| 4,596,540 | E. F'Geppert | Jun. 24, 1986 |
| 5,025,247 | J. Banks | Jun. 18, 1991 |
| 3,747,171 | A. Montague, Jr. | Jul. 24, 1973 |
| 4,065,834 | A. Montague, Jr. | Jan. 03, 1978 |
| 5,008,987 | T. Armour, II | Apr. 23, 1991 |
| 5,060,348 | D. Moshier | Oct. 29, 1991 |
| 3,370,818 | H. Perr | Feb. 27, 1968 |
| 5,002,381 | E. Murrell | Mar. 26, 1991 |

U.S. Pat. No. 4,406,296 teaches the use of hook and loop fastener material, such as that sold under the trademark VELCRO, in combination with beaded jewelry.

U.S. Pat. Nos. 4,596,540, 5,025,247, 3,747,171, 4,065,834 5,008,987 and 5,060,348 teach attaching two strap ends together with VELCRO-type fastener material.

U.S. Pat. No. 3,370,818 is notable because it is one of the first to teach using adhesively-attached VELCRO-type fasteners to hold articles together.

The rest of the patents are representative of what is in the art.

SUMMARY OF THE INVENTION

The present invention is a jewelry clasp comprised in part of hook and loop fastener material, such as that available under the brand name VELCRO.

A piece of hook (or loop) fastener material is glued or otherwise attached to a plastic or metal backing which acts as a first gripping member. The curved (preferably spoon-shaped) first gripping member has a circular eye-screw link protruding out from one side, which link may be tied onto or otherwise linked to one end of a standard necklace chain or string, so as to be more or less permanently secured thereto. A piece of loop (or hook) fastener material is attached to a generally congruently shaped second backing or gripping member, which material and gripping member, when linked with an eye-screw to the other end of the necklace, form the second half of the clasp. Preferably, the gripping members are formed of (or coated with) a precious metal such as silver or gold.

The two gripping members mate together with relatively loose tolerances. Insofar as the hook and loop fastener material will hold together even when the two pieces thereof are not matched exactly, the clasp readily may be fastened behind the neck by persons with impaired fine motor skills.

The mating of matching "male" and "female" gripping member portions relieves shear stress from the hook and loop portions, greatly increasing the strength of the clasp and prolonging the useful life of the hook and loop fastening material.

The clasp of this invention can be opened and shut without the need for using mobility at the metacarpophalangeal or interphalangeal joints, making it ideal for the estimated 20,000,000 suffers of arthritis in this country.

FEATURES AND ADVANTAGES

An object of this invention is to disclose a clasp apparatus which includes first and second gripping members, the first gripping member having at least one socket, and the second gripping member having at least one protruding portion which removably fits within the socket of the first gripping member. The clasp also includes first and second pieces of hook and loop fastener material, one piece thereof affixed within the socket of the first gripping member and the other piece thereof affixed onto the protruding portion of the second gripping member, so that the first and second pieces of hook and loop fastener material mate together when the protruding portion is in the socket. Means for linking the gripping members to an item to be clasped, such as a necklace or chain, are attached to the gripping members.

An advantage of this clasp is that the gripping member linking means is removably attached to the gripping member. This allows a plurality of linking means to be left more or less permanently affixed to a group of necklaces. Then, only one clasp is needed—it may be moved from one necklace to the next.

A further advantage or feature is that posts protrude outward from the gripping members, to which posts the pair of gripping member linking means are removably attached.

Yet another feature is that threads may be provided in each post so that the gripping member linking means can be a pair of eye-screws screwed into the threads of the posts.

A preferred feature is that the socket is smoothly concave and the protruding portion is smoothly convex, rendering the gripping members roughly spoon-shaped.

An alternate feature is that the socket and the protruding portion each may be generally congruent rectilinear sextahedrons (i.e. box-shaped).

Yet another desirable feature is that a hinged lid may be included on the second gripping member opposite from the protruding portion, the lid leading to a recess in the second gripping member in which recess small valuable objects may be stored.

Another feature is a clasp which is easy to use, attractive in appearance and suitable for mass production at relatively low cost.

Other novel features which are characteristic of the invention, as to organization and method of operation, together with further objects and advantages thereof will be better understood from the following description considered in connection with the accompanying drawing in which a preferred embodiment of the invention is illustrated by way of example. It is to be expressly understood, however, that the drawing is for the purpose of illustration and description only and is not intended as a definition of the limits of the invention.

Certain terminology and derivations thereof may be used in the following description for convenience in reference only and will not be limiting. For example, such words as "upwardly," "downwardly," "leftwardly," and "rightwardly" will refer to directions in the drawings to which reference is made unless otherwise stated. Similarly, such words as "inwardly" and "outwardly" will refer to directions toward and away from, respectively, the geometric center of a device or area and designated parts thereof.

DRAWING REFERENCE NUMERALS

Figure 1:
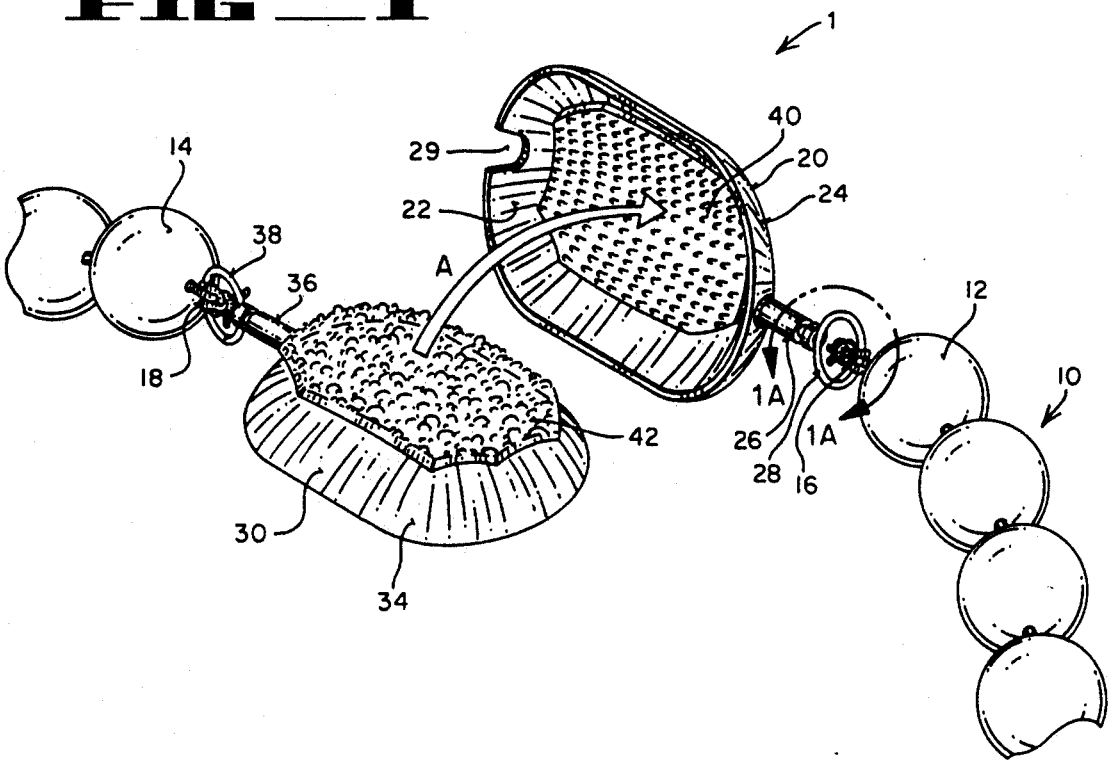
FIG. 1 is a perspective view of a preferred jewelry clasp of this invention in a first (unfastened) position.

1: clasp
10: necklace
12: first end of 10
14: second end of 10
16: first necklace linking means, on 12
18: second necklace linking means, on 14
20: top gripping member
22: concave side of 20
24: convex side of 20
26: first post, on 24
27: threads in 26
28: first eye-screw link, on 26
29: notch in 20
30: bottom gripping member of 1
32: concave side of 30
34: convex side of 30
36: second post, on 34
38: second eye-screw link, on 36
40: hook material
42: loop material
A–E: arrows
G: gap between 20 and 30
X: pivot point on 22, 34
101: clasp
110: necklace
112: first end of 110
114: second end of 110
116: first necklace linking means, on 112
118: second necklace linking means, on 114
120: top gripping member
122: inside socket of 120
124: outside of 120
125: top face of 124
126: first post, on 124
128: first eye-screw link, on 126
129: notch in 120
130: bottom gripping member of 101
134: protruding portion of 130
136: second post, on 134
138: second eye-screw link, on 136
140: loop material
141: adhesive layer of 140
142: hook material
150: lid of 130
152: hinge on 150
154: catch on 150
A′–D′: arrows
G′: gap between 120 and 130
X′: pivot point on 122, 134

DESCRIPTION OF A PREFERRED EMBODIMENT

Referring to FIG. 1, there is illustrated therein a jewelry clasp 1 of this invention. The clasp 1 may be used to fasten together the two ends of a necklace chain or string, such as the pearl or bead necklace 10. A first end 12 of the necklace 10 will have some form of first standard necklace linking means 16. In the example illustrated, this linking means is simply a knot. Alternatively, it may be a chain link or the like. The second end 14 of the necklace terminates in a second standard necklace linking means 18.

The body of the clasp 1 is comprised of two spoon-shaped gripping members, namely, top gripping member 20 and bottom gripping member 30. Note that the orientation of these members changes in the different views of the drawing. However, for consistency in labeling convention, the first member 20 will always be referred to as the "top" and the second member 30 will always be referred to as the "bottom," in accordance with the orientation of FIG. 1.

The first or top gripping member 20 has a downwardly-depending inner concave surface or side 22 and an upwardly protruding outer convex side 24. An attractive surface design (not illustrated) may be etched, embossed, printed or otherwise affixed to the outer side 24. A first post 26, or similar bored-thread member, protrudes laterally outward from the right side of the convex outer surface 24. A first conventional eye-screw 28 (linking means of the gripping member) is threaded into the post 26, forming a link to which the first linking means 16 of the necklace 10 may be fastened. On the left side of the top gripping member 20 is formed a notch 29, which notch is capable of providing clearance during fastening for a second post, namely post 36 (below).

The second or bottom gripping member 30 has a downwardly-depending inner concave side 32 and an upwardly protruding outer convex side 34. The concave side 22 of the first gripping member 20 serves as a socket into which fits the convex side 34 (protruding portion) of the second gripping member 30.

The internally-threaded second post 36 protrudes laterally outward from the left side of the convex side 34. A second conventional eye-screw 38 (second gripping member linking means) is threaded into the post 36, forming a link to which the second necklace linking means 18 of the second end 14 of the necklace 10 may be fastened. The linking means of the gripping members could incorporate means for linking a closed link, such as the closed, roughly circular, links that are commonly found on at least one end of necklace and bracelet chains. The circular part ("eye") of the gripping member linking means could be made to hinge or bend open, or it could be formed of spring metal having overlapping ends, such as is commonly used in key-chains.

It is contemplated that the clasps of this invention will be sold with a relatively large number of interchangeable eye-screw links 28, 38 in order that a pair of eye-screw links may be fastened to the ends of each and every necklace or similar item of jewelry owned by the purchaser. This may be an operation requiring some initial care and skill. However, the fastening of the screw links may be done in advance, under well-lighted conditions, and when time is available for careful work. Depending on the degree of impairment of the fine motor skills of the user, however, this operation may have to be done with assistance, or by someone else, such as a spouse, friend, nurse or the like.

Figure 1A:
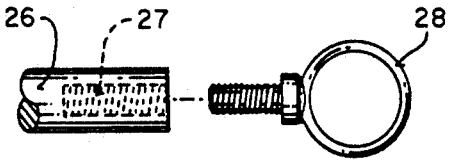
FIG. 1A is an exploded detail view of the eye-screw link of the clasp of FIG. 1 taken along line 1A—1A thereof.

Thereafter, one clasp 1 will suffice for all of said jewelry items. Prior to the use of a particular necklace 10, one merely needs to screw (with or without assistance) the pre-linked eye-screw 28 of the first end 12 into the internal threads 27 of the top member's post 26 (FIG. 1A) and the pre-linked eye-screw 38 of the second end 14 into the second post 36. It is to be noted that, for reasons of esthetics, the posts might be able to project into their respective gripping members, provided that suitable accommodation be made for mating the members together (e.g. by adding a second notch).

Interlocking hook and loop material is fastened to the encapsulated mating surfaces of the two gripping members 20, 30. For example, the upper region of the inner concave side 22 of the top member 20 may have hook material 40 adhesively affixed to it and loop material 42 may be affixed in a matching position on the upper region of the convex side 34 of the bottom member 30. Preferably, the patches of material 40, 42 will curve down the sides of the mating surfaces 22, 34, for reasons explained below. However, it obviously does not matter which member bears which type of the two types of interlocking material.

Figure 2:
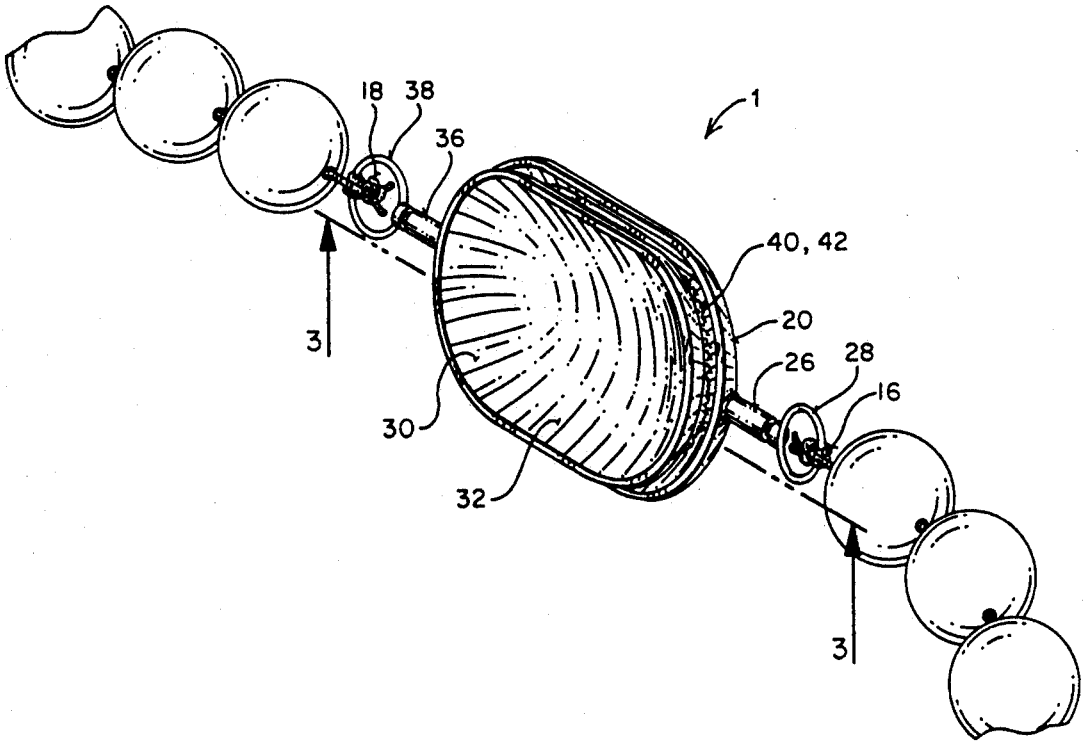
FIG. 2 is a perspective view of the clasp of FIG. 1 in a second (fastened) position.

FIG. 2 illustrates the mating of concave 22 and convex 34 surfaces which occurs when the two gripping members 20, 30 are brought together in the general direction of arrow A of FIG. 1. Note that precision is not at all required in this operation, insofar as the hook and loop material 40, 42 will interlock securely within a relatively large range of placement locations. This allows the necklace to be fastened quickly and safely (even when behind the neck) by a user having impaired fine motor skills, such as one suffering from arthritis, vision impairment or the like.

Figure 3A:
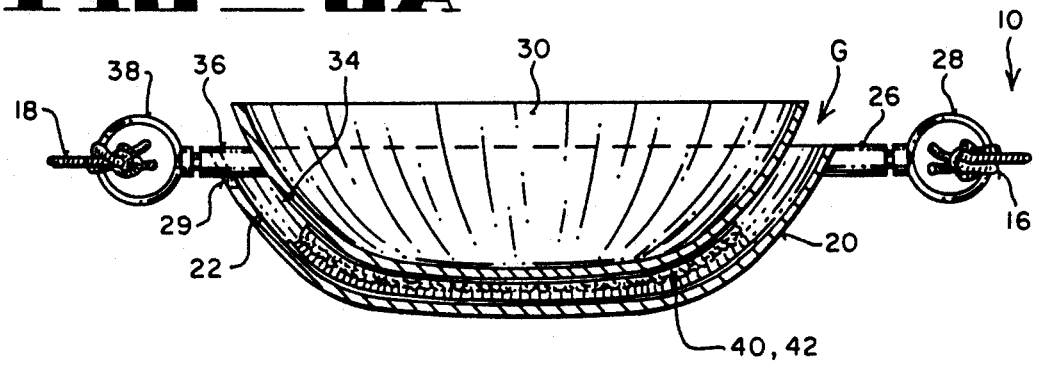
FIGS. 3A and 3B are sectional elevations of the clasp, generally taken along line 3—3 of FIG. 2.

FIG. 3A shows this mating in cross-section. Note that the thickness of the combined hook 40 and loop 42 materials causes a substantial gap G to remain open between gripping member 20 and gripping member 30. This gap is available for the insertion of a fingertip or fingernail of the user so that the necklace 10 may be just as readily unfastened as fastened.

Figure 3B:
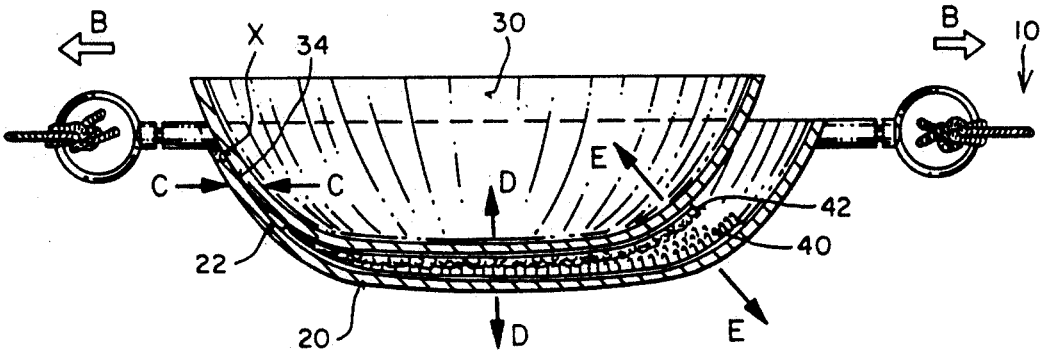

FIG. 3B illustrates the effect of pulling the ends of the necklace apart in the direction of arrows B, which might occur should the necklace become caught in clothing, furniture or the like. The VELCRO-type fastener material is not able readily to resist much shear (side-to-side) force. Ordinarily, first the hooks slide to the side (due to slack within the loops) and then they start to release. Even in the present invention, some of this occurs. FIG. 3B shows that some hooks and loops on the right have become disengaged by shear stress experienced by the fastener material in the direction of arrows B.

Eventually, however, shear separation is halted by the contact of the left sides of the members 20, 30, namely, in the vicinity of the pivot point X which is located where the leftmost outer surface of the convex side 34 of the "bottom" (top in FIG. 3) gripping member 30 presses against the leftmost inner surface of the concave side 22 of the top gripping member 20. Thereafter, further tension along the direction of arrows B is absorbed and resisted by compression of the gripping members against each other in the direction of arrows C. To some extent, a pivoting action is set up around point X. However, this is resisted by the hook and loop fasteners 40, 42 in directions perpendicular to the planes of the material, i.e. along arrows D. This is the direction of pull which hook and loop fasteners best resist.

Furthermore, as noted, the surfaces to which the fasteners 40, 42 are affixed curve around to the side (i.e. the end portions of the normally flat backing of the hook and loop material are angled with respect to the middle portion). Therefore, material in the vicinity of arrows E first must be pulled apart at least obliquely (if not perpendicularly) even before the shear in the middle section releases these rightmost hooks.

Nevertheless, the material will eventually give way, and the members 20, 30 will separate. This is necessary, however, to prevent the necklace 10 from choking the wearer, to prevent the necklace itself from breaking, and to allow the gripping members to be pulled apart when it is desired to unfasten the clasp. The use of hook and loop fastener material, together with the shear-absorbing configuration of the gripping members, provides a secure grip under most normal stresses without undue failure of the fastener material—such as separation of the adhesive layer which typically holds the material onto the surface to which it is attached (see the adhesive layer of FIG. 4).

The mating spoon-shaped gripping members 20, 30 of the clasp 1 are attractive, easy to produce by stamping, and surprisingly effective. However, this is not the only shape of clasp which is possible under this invention. All that is necessary is a pin-like protrusion on one member and a correspondingly-shaped socket on the other, together with hook and loop fastening material entrapped between the top of the protruding portion and the inner end of the socket.

Figure 4:
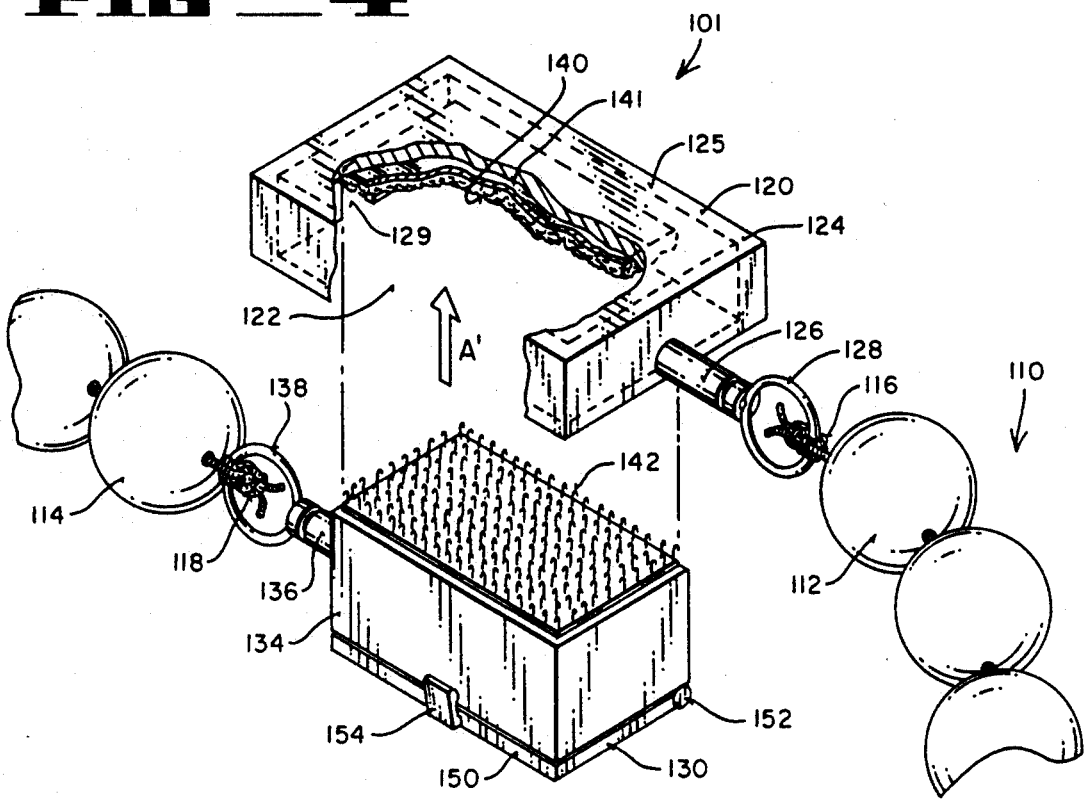
FIG. 4 is a perspective view of an alternate embodiment of this invention in a first (unfastened) position.

As an example, referring to FIG. 4, there is illustrated therein an alternate jewelry clasp 101 of this invention. It is to be noted that, for convenience, the last two positions of the reference numerals of alternate embodiments of the invention duplicate those of the numerals of the embodiment of FIG. 1, where reference is made to similar or corresponding parts. However, it should not be concluded merely from this numbering convention that similarly numbered parts are equivalents.

The clasp 101 is used to fasten together the two ends of a necklace 110. A first end 112 of the necklace 110 has a first standard necklace linking means 116 such as a link or a knot. The second end 114 of the necklace similarly terminates in a second standard necklace linking means 118.

The body of the clasp 101 is comprised of two generally box-shaped (i.e. rectilinear sextahedron) gripping members, namely, top gripping member 120 and bottom gripping member 130. The flat, mutually perpendicular, walls of the top gripping member 120 form a downwardly-depending inner box-shaped socket 122 and a box-shaped outside 124. A first post 126 protrudes laterally outward from the right side of the outside surface 124. A first eye-screw 128 (first linking means of the gripping member) is threaded into the post 126, forming a link to which the first linking means 116 of the necklace 110 may be fastened. On the left side of the top gripping member 120 is formed a notch 129, which notch is capable of accommodating the second post 136 during fastening.

The bottom gripping member 130 has an upwardly protruding outer box-shaped mating or protruding portion 134. The second post 136 protrudes laterally outward from the left side of the protruding portion 134. A second eye-screw link 138 (second gripping member linking means) is threaded into the post 136, to which post the second linking means 118 of the second end 114 of the necklace 110 may be fastened.

Interlocking hook and loop material is fastened to the mating surfaces of the two gripping members 120, 130. For example, the upper flat top face within the box-shaped inner socket 122 of the top member 120 may have loop (or hook) material 140 affixed to it by means of an adhesive layer 141. The socket designs of the present invention are so effective in protecting the hook and loop material from undue stress that ordinary VELCRO brand tape adhesive will suffice for this layer. When the adhesive layer 141 does lose its bonding power, as may be expected after many successive uses of the clasp, it is a simple matter to remove material 140 and replace it with a fresh tape-like patch.

Replaceable hook (or loop) material 142 is affixed in a matching position on the upper flat top face of the box-shaped protruding portion 134 of the bottom member 130.

The inside of the box of the lower gripping member 130 preferably forms a hollow recess, which recess will be available for storing small valuable objects, such as emergency medical information, the owner's address, a small key, or the like. To this end, a lid may be affixed to the bottom of member 134 by means of a hinge 152. A suitable catch 154 allows the recessed interior of member 130 to be accessed selectively. A similar lid could be added to the bottom gripping member 30 of the spoon-shaped clasp 1.

Figure 5:
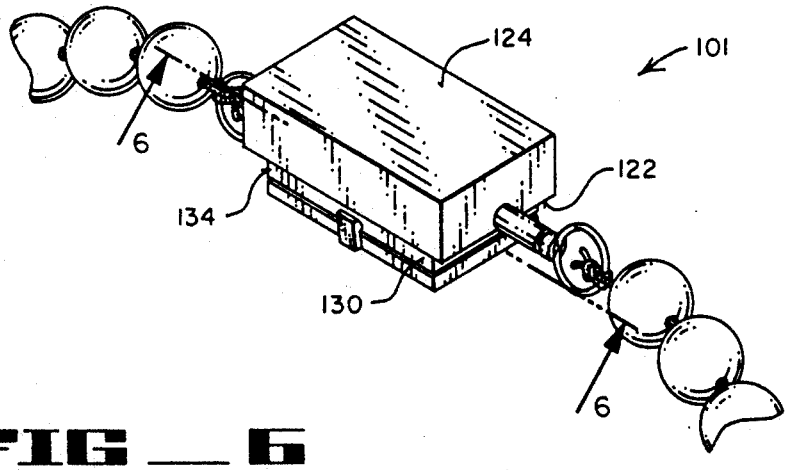
FIG. 5 is a perspective view of the clasp of FIG. 4 in a second (fastened) position.

FIG. 5 illustrates the mating of the surfaces of the socket 122 and the protruding portion 134 which occurs when the two gripping members 120, 130 are brought together in the general direction of arrow A' of FIG. 4. To allow convenient use by persons experiencing fine motor skill impairment, the socket 122 is made considerably larger than the protruding portion 134. Again, due to the "forgiving" nature of hook and loop fastening material, precision alignment is not necessary.

Figure 6:
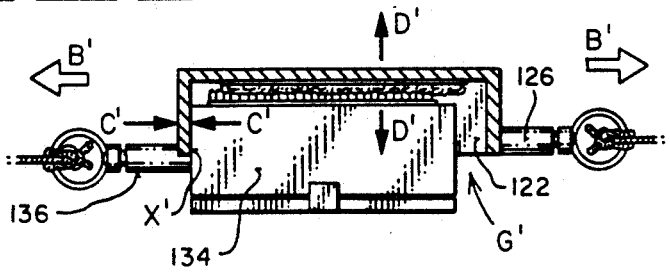
FIG. 6 a sectional elevation of the clasp of FIG. 4, taken along line 6—6 of FIG. 5.

FIG. 6 shows this mating in cross-section. Note that the thickness of the combined loop 140 and hook 142 materials again causes a substantial gap G' to remain open between gripping member 120 and gripping member 130 so that the clasp 101 easily may be grasped for unfastening.

FIG. 6 illustrates the effect of pulling the ends of the necklace apart in the direction of arrows B'. FIG. 6 shows that some of the hooks on the left have become disengaged from their associated loops due to the shear forces encountered. Eventually, however, shear separation is halted by the contact of the left sides of the members 120, 130 in the vicinity of pivot point X'. Thereafter, further tension along arrows B' is absorbed and resisted by compression of the gripping members against each other in the direction of arrows C'. To the extent that a pivoting action is set up around point X' it is resisted by the hook and loop fasteners 142, 140 in the direction perpendicular to the planes of the material, i.e. along arrows D'. As was the case with the clasp 1, this is the direction of pull which hook and loop fasteners best resist.

While the above provides a full and complete disclosure of the preferred embodiments of this invention, various modifications, alternate constructions, and equivalents may be employed without departing from the true spirit and scope of the invention. Such changes might involve alternate materials, components, structural arrangements, sizes, operational features or the like. For example, it will be clear to one of ordinary skill in the art that the clasp of this invention can easily be adapted to belt buckles, ties, bracelets, and the like. More than one socket might be employed, e.g. each gripping member might have a pair of spoon-shaped domes. Therefore, the above description and illustrations should not be construed as limiting the scope of the invention which is defined by the appended claims.

What is claimed is:

1. Clasp apparatus including:

first and second gripping members, the first gripping member having at least one socket, the second gripping member having at least one protruding portion which removably fits within the socket of the first gripping member;

first and second pieces of hook and loop fastener material, one piece thereof affixed within the socket of the first gripping member and the other piece thereof affixed onto the protruding portion of the second gripping member, so that the first and second pieces of hook and loop fastener material mate together when the protruding portion is in the socket; and means attached to at least one gripping member for linking that gripping member to an item to be clasped, and wherein the gripping member linking means is removably attached to the gripping member.

2. The apparatus of claim 1 further including:

a post protruding outward from at least one gripping member, to which post the gripping member linking means is removably attached.

3. The apparatus of claim 2 further including:

threads in the post, and wherein the gripping member linking means is an eye-screw screwed into the threads of the post.

4. The apparatus of claim 3 wherein:

there are two posts and two eye-screws and wherein the socket is smoothly concave and the protruding portion is smoothly convex.

5. The apparatus of claim 3 wherein:

the socket and the protruding portion are each generally congruent rectilinear sextahedrons.

6. Clasp apparatus including:

first and second gripping members, the first gripping member having at least one socket, the second gripping member having at least one protruding portion which removably fits within the socket of the first gripping member;

first and second pieces of hook and loop fastener material, one piece thereof affixed within the socket of the first gripping member and the other piece thereof affixed onto the protruding portion of the second gripping member, so that the first and second pieces of hook and loop fastener material mate together when the protruding portion is in the socket;

means attached to at least one gripping member for linking that gripping member to an item to be clasped; and a post protruding outward from at least one gripping member, to which post the gripping member linking means is removably attached.

7. Clasp apparatus including:

first and second gripping members, the first gripping member having at least one socket, the second gripping member having at least one protruding portion which removably fits within the socket of the first gripping member;

first and second pieces of hook and loop fastener material, one piece thereof affixed within the socket of the first gripping member and the other piece thereof affixed onto the protruding portion of the second gripping member, so that the first and second pieces of hook and loop fastener material mate together when the protruding portion is in the socket; and means attached to at least one gripping member for linking that gripping member to an item to be clasped, and wherein the socket and the protruding portion are each generally congruent rectilinear sextahedrons.

8. Clasp apparatus including:

first and second gripping members, the first gripping member having at least one socket, the second gripping member having at least one protruding portion which removably fits within the socket of the first gripping member;

first and second pieces of hook and loop fastener material, one piece thereof affixed within the socket of the first gripping member and the other piece thereof affixed onto the protruding portion of the second gripping member, so that the first and second pieces of hook and loop fastener material mate together when the protruding portion is in the socket;

means attached to at least one gripping member for linking that gripping member to an item to be clasped; and a hinged lid on the second gripping member opposite from the protruding portion, the lid leading to a recess in the second gripping member in which small objects may be stored.

9. Jewelry clasp apparatus including:

first and second gripping members, the first gripping member having a socket, the second gripping member having a protruding portion which removably fits within the socket of the first gripping member, the shape of the protruding portion being generally congruent to the shape of the socket;

first and second pieces of hook and loop fastener material, one piece thereof affixed within an inner surface of the socket of the first gripping member and the other piece thereof affixed onto an outer surface of the protruding portion of the second gripping member, so that the first and second pieces of hook and loop fastener material mate together when the protruding portion is fit within the socket; and a pair of means for linking the gripping members to an item of jewelry, one such gripping member linking means attached to each gripping member.

10. The apparatus of claim 9 wherein:

portions of each piece of fastener material are angled with respect to other portions of the same piece wherein a force applied to one piece of fastener material that causes stress parallel to one portion of that piece of fastener material causes obliquely angled stress to at least one other portion of that piece of fastener material.

11. The apparatus of claim 10 wherein:

each gripping member linking means may be removed from the gripping member to which it is attached.

12. The apparatus of claim 11 further including:

threads in each gripping member, and wherein each gripping member linking means is an eye-screw screwed into the threads of the gripping member to which it is attached.

13. The apparatus of claim 12 wherein:

the socket is smoothly concave and the protruding portion is smoothly convex.

14. The apparatus of claim 9 further including:

a hinged lid on the second gripping member opposite from the protruding portion, the lid leading to a recess in the second gripping member in which small objects may be stored.

* * * * *